United States Patent [19]

Soldatovic

[11] Patent Number: 4,809,391

[45] Date of Patent: Mar. 7, 1989

[54] APPARATUS FOR REMOVING ASBESTOS FROM PIPES

[76] Inventor: Dragisa Soldatovic, 55 Teak Rd., Wayne, N.J. 07470

[21] Appl. No.: 216,886

[22] Filed: Jul. 8, 1988

[51] Int. Cl.[4] ..... B08B 5/00

[52] U.S. Cl. ..... 15/301; 15/310; 15/314; 55/97; 55/356; 55/385.2; 98/115.3; 98/115.4; 312/1

[58] Field of Search ..... 15/300 R, 314, 301, 15/310; 98/115.3, 115.4; 55/97, 356, 385 A, 467, 473; 312/1

[56] References Cited

U.S. PATENT DOCUMENTS

| | | | |
|---|---|---|---|
| 2,299,987 | 10/1942 | Hunter | 15/300 R |
| 2,781,536 | 2/1957 | Paul | 15/310 X |
| 3,295,298 | 1/1967 | Mackey | 15/310 X |
| 4,214,317 | 7/1980 | Kelly | 2/2 |
| 4,626,291 | 12/1986 | Natale | 98/115.3 |
| 4,682,448 | 7/1987 | Healey | 55/356 X |
| 4,706,551 | 11/1987 | Schofield | 98/1 |
| 4,765,352 | 8/1988 | Strieter | 98/115.4 |

FOREIGN PATENT DOCUMENTS

| | | | |
|---|---|---|---|
| 656863 | 2/1938 | Fed. Rep. of Germany | 15/314 |
| WO86/5431 | 9/1986 | PCT Int'l Appl. | 312/1 |

*Primary Examiner*—Chris K. Moore

*Attorney, Agent, or Firm*—Klauber & Jackson

[57] ABSTRACT

Apparatus for removing asbestos material from horizontally arranged pipes in a linear, T-shaped or L-shaped configuration includes a rigid box-like device having a rectangular bottom wall and four side wall sections which extend upwardly from peripheral edges of the bottom wall so as to define a continuous side wall and so as to define an enclosure therebetween, the side wall having an upper edge with two pair of opposing recesses formed orthogonally with respect to each other in the upper edge of the continuous side wall for receiving the pipes, the upper end of the box-like device defined by the upper edge of the continuous side wall being open; a plurality of glove apertures formed in two opposing side walls, a glove associated with each glove aperture, each glove connected to the side wall in sealing relation to the respective glove aperture and extending into the enclosure; two suction apertures formed in the remaining side walls for connection to a negative pressure system to supply negative pressure to the enclosure; a filter in covering relation to each suction aperture to trap any airborne asbestos material; and a removal aperture formed in the bottom wall for connection to a container device so as to remove bulky portions of the asbestos material which have been removed from the pipes.

26 Claims, 3 Drawing Sheets

APPARATUS FOR REMOVING ASBESTOS FROM PIPES

BACKGROUND OF THE INVENTION

This invention relates generally to apparatus for removing contaminant material from a building and, more particularly, is directed to a box-like device for removing asbestos from horizontally and vertically arranged pipes.

The term asbestos is given to a group of naturally occurring minerals called hydrated silicates that are fibrous in nature and have certain desirable physical characteristics, primarily heat resistance. To be classified as fibrous, the mineral is required to be one in which the length of the particle is at least three times as long as its width. The outstanding physical characteristics, in addition to heat resistance, which have accounted for the wide commercial use of asbestos include a high tensile strength, insulating ability and high resistance to acid.

Asbestos fibers have been used in hundreds of commercial products in the United States such as heat-resistant textiles, thermal insulations, construction products such as ceiling tiles and wall boards, gaskets and brake linings. In many instances, and particularly in industrial plants, asbestos has been used as an insulating material for high temperature pipes.

The Environmental Protection Agency has recently reported at Page A15 of the Mar. 1, 1988 edition of the New York Times that more than 500,000 office buildings, apartment houses, stores and other public and commercial buildings contain potentially dangerous loose asbestos in deteriorating condition.

It is well documented that asbestos-related diseases are generally classified into five different categories, namely asbestosis which is a type of pulmonary disease caused by inhalation of the asbestos dust, pleural disease which relates to changes in the pleura (the membranes enveloping the lungs and the pleural cavity) caused by inhalation of the asbestos fiber, lung cancer, mesothelioma which is a form of cancer of the pleural and peritoneal cavities, and other cancers such as laryngeal cancer and cancer of the gastrointestinal tract.

As a result of the above, there has been an outcry for asbestos removal in office and apartment buildings and in factories, requiring a great amount of expenditures and time for such asbestos removal.

One particularly troublesome area of asbestos removal is that of removing asbestos materials from horizontally and vertically arranged pipes, for example, those which are exposed in factories and the like. Typically, the entire room is sealed and the asbestos-laden insulation is scraped from the pipes and permitted to fall to the ground where it is cleaned. However, this results in a great deal of asbestos fibers circulating in the air and it becomes difficult to satisfactorily clean the room of such asbestos fibers. Further, the time and cost in sealing the room becomes prohibitive.

In this regard, it has been known to wrap a plastic bag about a small section, for example, a three foot section of pipe. The bag has glove holes, whereby the asbestos can be scraped from the pipe, from which it then falls into the bag. An example of such a bag is disclosed in U.S. Pat. No. 4,626,291 to Natale. In addition, such bag may commercially be provided with a hole for suction removal to remove dust, whereby the main portion of the bag holds the large chunks of asbestos scraped from the pipe. However, there is a large delay in wrapping the bag around the pipe and accordingly, it takes approximately one-half hour or more to remove asbestos from a three foot pipe length. Also, such bag cannot be used with steam pipes which would melt the bag. Therefore, this bag is not used during the winter time.

U.S. Pat. No. 4,505,190 to Fink et al discloses a portable maintenance exhaust hood which isolates sections of piping for maintenance and repair. The hood has a transparent front panel to provide a clear viewing shield which can be adjusted between an open and close position. A collapsible frame is used for supporting the hood which is made of a flexible material. In addition, such hood provides a drain aperture formed through the bottom wall of the enclosure and connected to a disposable container by a conduit. A vacuum unit is also provided and is connected to the enclosure by means of a conduit. The end walls of the enclosure are provided with closure flaps which are secured over the pipe passing therethrough.

This latter patent is used for carrying out maintenance and repair procedures upon installed pipes and other conduits without disassembling them, and particularly on sections that include joints, valves and similar in-line fixtures. Thus, this apparatus is particularly applicable for facilities such as nuclear and chemical plants in which the performance of such work exposes personnel to serious hazards, such as from noxious and dangerous gases, liquids and particulates. In the first place, with this apparatus, the frame structure shown in FIG. 6 of the patent effectively requires the enclosure to be built around the pipe. In addition, in order to provide an opening for access to the pipe, the front flap is opened, thereby subjecting the room environment to any hazardous materials. Still further, this device is not provided for removing contaminate material, such as asbestos from pipes. In addition, such apparatus can only be used with linearly oriented pipes and could not be used with T-shaped, L-shaped, and the like pipes, and could not be used with pipes positioned near the ceiling of a room.

An enclosure is also known for removing asbestos and is sold under the designation "AERO-PIPE CAPSULE" by Aerospace America, Inc., 900 Truman Parkway, Bay City, Mich. 48707. With this arrangement, an entire enclosure is provided around the pipe. The enclosure is provided under constant negative air pressure and includes a built-in water/slash surfactant wetting applicator, with waste being collected in conventional bags. This enclosure uses end cuffs which are interchangeable to accommodate pipes of different diameters and uses gloved openings in the enclosure. The Aerospace America, Inc. brochure discloses different systems for different arrangements of pipes. For example, Model Nos. APC-001 and APC-002 are designed as horizontal capsules, Model Nos. APC-003 and APC-004 are designed as one-man horizontal capsules, Model Nos. APC-005 and APC-006 are designed as vertical pipe capsules, Model Nos. APC-007 and APC-008 are designed as up-tee and up-elbow capsules. Model Nos. APC-009 and APC-010 are designed as down-tee and down-elbow capsules, Model Nos. APC-011 and APC-012 are designed as valve capsules and Model Nos. APC-013 and APC-014 are designed as horizontal-tee and elbow, and horizontal-elbow capsules, respectively. It is clear that different Aerospace America, Inc. capsules are needed for different arrangements of pipes and valves, and therefore, such system can become expensive where different capsules or end caps are needed for different pipe arrangements contained in the same room.

U.S. Pat. No. 4,566,293 to Arner et al discloses a box enclosure for a sample preparation and includes gloved openings. However, such apparatus could not be used for removing asbestos from pipes.

U.S. Pat. No. 2,999,448 to Abler et al discloses a dust free work bench apparatus which also could not be used for removing asbestos from pipes.

U.S. Pat. No. 4,438,977 to Chapel discloses apparatus for removing asbestos from walls without contaminating the ambient environment. In such apparatus, a box-like device is provided which is open at the upper end thereof and includes a suction and receptacle unit connected thereto. At the open upper end, a scraping means is provided for scraping material from a wall or ceiling and a suction is also provided in the box to prevent the asbestos fibers from escaping into the room atmosphere. However, this patent could not be used for removing asbestos from pipes.

Other devices which are less relevant than those discussed above, but which the Examiner may consider material to the examination of the above identified application are U.S. Pat. Nos. 2,064,660; 2,147,190; 2,984,263; 2,927,338; 3,461,478; 3,775,806; 4,049,321; and 4,263,693.

OBJECTS AND SUMMARY OF THE INVENTION

Accordingly, it is an object of the present invention to provide apparatus for removing contaminant material from pipes that overcomes the aforementioned difficulties encountered with the prior art.

It is another object of the present invention to provide apparatus for removing contaminant material from horizontally arranged pipes having a linear, T-shaped or L-shaped configuration.

It is still another object of the present invention to provide apparatus for removing contaminant material from vertically arranged pipes.

It is yet another object of the present invention to provide apparatus for removing contaminant material from pipes, while also preventing asbestos fibers from escaping into the room atmosphere.

It is a further object of the present invention to provide apparatus for removing contaminant material from pipes with a minimal amount of effort, time and expense.

It is a still further object of the present invention to provide apparatus for removing contaminant material from pipes in which the bulky contaminant material can be easily disposed of in a bag or other container.

It is a yet further object of the present invention to provide apparatus for removing contaminant material from pipes in which a controlled environment is provided where the debris can be disposed of more efficiently and in a less hazardous manner to the workers.

It is another object of the present invention to provide apparatus for removing contaminant material from pipes that is relatively easy and inexpensive to manufacture and use.

In accordance with an aspect of the present invention, apparatus for removing contaminant material from at least one horizontally arranged pipe, comprises a rigid box-like device including a lower portion having a periphery, and a substantially continuous side wall extending upwardly from the periphery of the lower portion so as to define an enclosure, the side wall having an upper edge: the box-like device having an open upper end defined by the upper edge of the side wall; at least one pair of opposing recesses formed at the upper edge of said side wall for receiving the at least one pipe; at least one glove aperture formed in the side wall and/or lower portion; a glove associated with each glove aperture, each glove connected to the side wall and/or lower portion in sealing relation to the respective glove aperture and extending into the enclosure; at least one suction aperture formed in the side wall and/or the lower portion; and at least one removal aperture formed in the side wall and/or the lower portion.

In accordance with another aspect of the present invention, apparatus for removing contaminant material from a vertically arranged pipe, includes a rigid box-like device having a lower portion with a periphery, an upper portion with a periphery and a side wall extending between the peripheries of the lower and upper portions so as to define an enclosure; the side wall, the lower portion and the upper portion each being open along a portion thereof in communication with each other, such that a vertically arranged pipe can fit within the open portions of the lower portion, the upper portion and the side wall so as to be positioned adjacent the enclosure; at least one glove aperture formed in the box-like device; a glove associated with each glove aperture, each glove connected to the box-like device in sealing relation to the respective glove aperture and extending into the enclosure; at least one suction aperture formed in the box-like device; and at least one removal aperture formed in the box-like device.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figure 1:
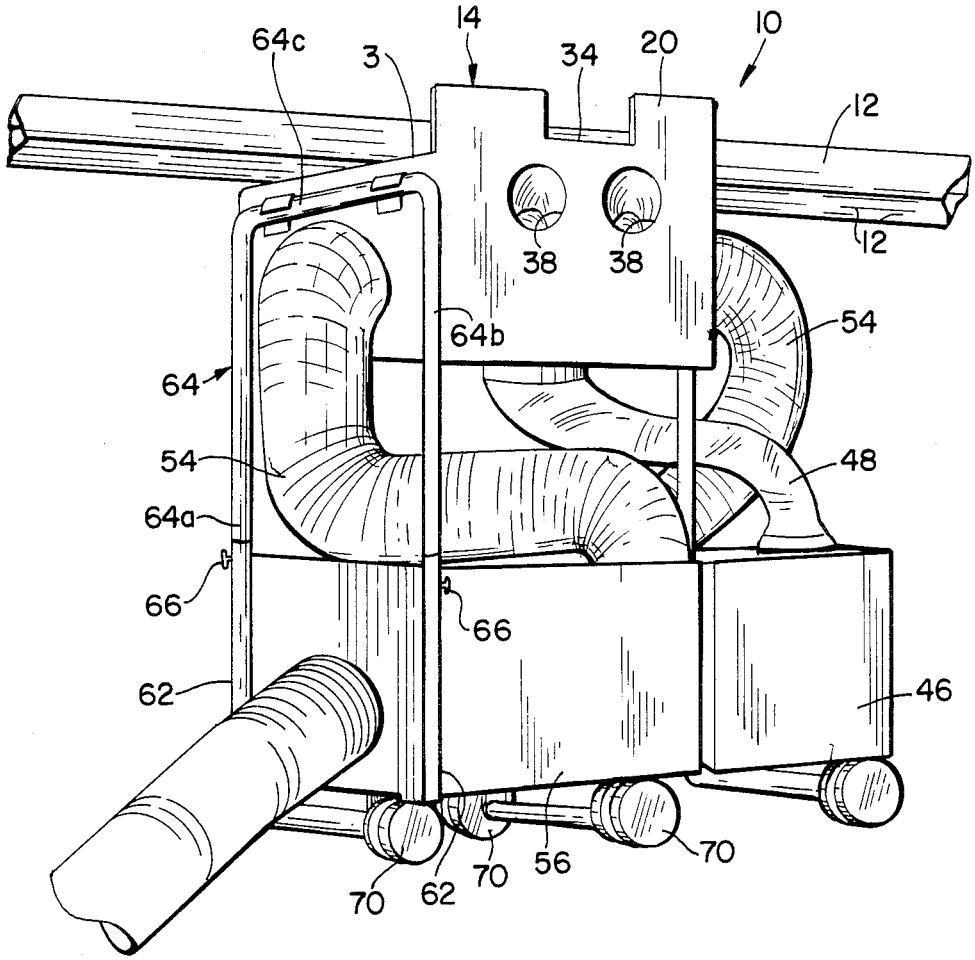
FIG. 1 is a perspective view of apparatus for removing contaminant material from horizontally arranged pipes according to the present invention.

Referring to the drawings in detail, and initially to FIGS. 1–4 thereof, apparatus 10 for removing contaminant material, such as asbestos from horizontally arranged pipes 12 includes a box-like device 14 having a lower portion defined by a bottom wall 16, preferably having a rectangular configuration, and four side walls 18, 20, 22 and 24, each extending vertically upward from a peripheral side edge of bottom wall 16, with side walls 18, 20, 22 and 24 forming a continuous side wall 26. Bottom wall 16 and continuous side wall 26 define an enclosure 28 therein. It is a key element to the present invention that box-like device 4 has an open upper end defined by the upper edges of side walls 18, 20, 22 and 24.

In many instances, horizontally arranged pipes are located close to the ceiling of a room. It is therefore necessary to permit box-like device 14 to receive such horizontally arranged pipes. In this regard, a first pair of opposing recesses 30 and 32 is formed at the upper edge of continuous side wall 26, and particularly at the upper edges of side walls 18 and 22, respectively. Because of this arrangement, linearly arranged horizontal pipes 12 can be positioned within enclosure 28, even if such pipes 12 are positioned close to the ceiling of a room.

In addition, a second pair of opposing recesses 34 and 36 is formed at the upper edge of continuous side wall 26, 90° offset from recesses 30 and 32. Specifically, recesses 34 and 36 are formed at the upper edges of side walls 20 and 24 for receiving at least one pipe therein. Because of this arrangement, horizontal pipes arranged in a T-configuration and a L-configuration can be received within enclosure 28. For example, for a L-shaped arrangement, the pipe can enter recess 30 and exit recess 34. For a T-shaped arrangement, the pipe can enter recess 30 and exit recesses 34 and 36. Thus, recesses 30, 32, 34 and 36 can receive horizontally arranged pipes in a plurality of different configurations, such as linearly arranged pipes, T-shaped shaped pipes and L-shaped pipes, so that only one box-like device 14 is required for removing asbestos from all horizontally arranged pipes, regardless of the configuration thereof.

In addition, side walls 20 and 24 are each provided with glove apertures 38, and a glove 40 having finger portions 42 at the end thereof is associated with each glove aperture 38. Specifically, the open end of each glove 40 is secured to the respective side wall 20 and 24 in surrounding, and thereby sealing, relation to the respective glove aperture 38, with each glove 40 extending into enclosure 28. Thus, when pipes 12 are positioned within enclosure 28, for example, as shown in FIG. 1, a worker can insert his hands through gloves 40 and finger portions 42 thereof and, with the aid of tools (not shown), such as a knife, circular nylon brush, a power drill and the like can remove the asbestos material surrounding the pipes 12.

In such case, the large chunks of asbestos material that are removed from pipes 12, will fall into enclosure 28, and particularly, onto bottom wall 16 thereof. In this manner, a removal aperture 44 is formed in bottom wall 16. Thus, the worker, through gloves 40, can push the chunks of asbestos material through removal aperture 44. In this regard, removal aperture 44 is connected with a waste container 46 through a conduit 48, as shown in FIG. 1, whereby the bulk waste asbestos material is contained in waste container 46 for disposal. Alternatively, a conventional waste disposal bag can be secured to bottom wall 16 in surrounding relation to removal aperture 44.

When cutting, scraping and otherwise removing the asbestos material from pipes 12, the asbestos fibers tend to fly about, and thereby contaminate the room. Accordingly, suction apertures 50 are formed in side walls 18 and 22 and include outer circular flanges 52 by which suction conduits 54 can be connected thereto, the opposite ends of suction conduits 54 being connected to a negative pressure system 56, as shown in FIG. 1. An example of a negative pressure system that can be used is that sold under the designation "MACH 2" by Critical Systems, 5815 Gulf Freeway, Houston, Tex. 77023. Another example of a negative pressure system that can used is that sold under the designation "RED BARON" by Global Consumer Services, Inc., 3607 West Pacific Ave., Burbank, Calif. 91505. Further, suction apertures 50 are each preferably covered with a pre-filter 58 which permits air to pass therethrough, but which prevents the passage of asbestos fibers. Pre-filters 58 and screens (not shown) are removably secured to the inner surfaces of side walls 18 and 22. In this manner, the free floating asbestos fibers formed by the cutting, scraping and the like operation are pulled into box-like device 14 by negative pressure system 56 and are trapped by filters 58, which can be changed periodically. Further, filters (not shown) are provided in negative pressure system 56, as is conventional.

In addition, a light 60 is provided through side wall 22 for illuminating the pipe to be scraped. Light 60 is a ground faulted GFI light which is resettable if water enters the circuitry thereof. In this regard, light 60 is sealed against water. This is important since, prior to the cutting and scraping operation, the asbestos insulation is conventionally wetted.

In order to mount box-like device 14 for asbestos removal, as shown in FIG. 1, negative pressure system 56 includes two outer tubular posts 62 extending upwardly therefrom. A U-shaped bar 64 has its legs **64*a* and 64*b* telescopically received within outer tubular posts 62 so as to be adjustable in the vertical direction in FIG. 1. Locking bolts 66 or the like extend through outer tubular posts 62 and can be used to lock U-shape bar 64 in any desired vertical position. In this regard, clips 68 are formed on the outer surface of side wall 18 on opposite sides of suction aperture 50. Clips 68 fit over and clip onto the connecting leg 64*c* of U-shaped bar 64, as shown in FIG. 1, so as to support box-like device 14 at any desired vertical position. In this regard, negative pressure system 56 can be movably supported on wheels 70 so that box-like device 14 can be moved along different lengths of pipes 12 by merely moving negative pressure system 56 to a different position. Of course, any other suitable supporting means can be provided for box-like device 14**, such as a scaffold arrangement or the like. However, the above-described supporting arrangement is preferred for pipes located nine feet or less above the ground, and the scaffold arrangement is preferred for pipes located at a height greater than nine feet off the ground.

In operation, box-like device 14 is supported on U-shaped bar 64 and moved to the appropriate height such that pipes 12 selectively fit within recesses 30, 32, 34 and 36, depending upon the arrangement of the pipes. Thereafter, the negative pressure system 56 is operated. The worker wets the insulation jacket containing the asbestos fibers which surround the pipe and cuts and removes such insulation jacket. The worker then scrapes off any additional material remaining on the pipes. Such insulation material falls into box-like device 14 and is pushed through removal aperture 44 where the material travels to waste container 46 through conduit 48. At the same time, negative pressure system 56 pulls all air containing the asbestos fibers through suction apertures 50, and the pre-filters 58 filter out the asbestos fibers. Any asbestos fibers that happen to pass through pre-filters 58 are trapped in filters provided in negative pressure system 56, as is conventional. After a section, for example, a three foot section of pipes 12, has been cleaned, box-like device 14 is moved to the next three foot section of pipes 12 to repeat the operation.

Thus, with the present invention, there is no need to wrap the pipes with a bag as has conventionally been performed. It will be appreciated that, to remove asbestos material from a three foot pipe length has taken approximately one-half hour with the prior art bags, and such removal operation can occur in a time span of five minutes or less with the present invention. There is also no need to totally enclose the pipes to be worked on and in this regard box-like device 14 is provided with an open upper end. Still further, box-like device 14 is able to accommodate pipes of different configurations, for example, linearly arranged pipes, T-shaped pipes, and L-shaped pipes, in addition to other configurations. Also, the invention is particularly useful with steam pipes since the workers are protected from the hot steam, and accordingly, the invention can be used all year round.

Figure 5:
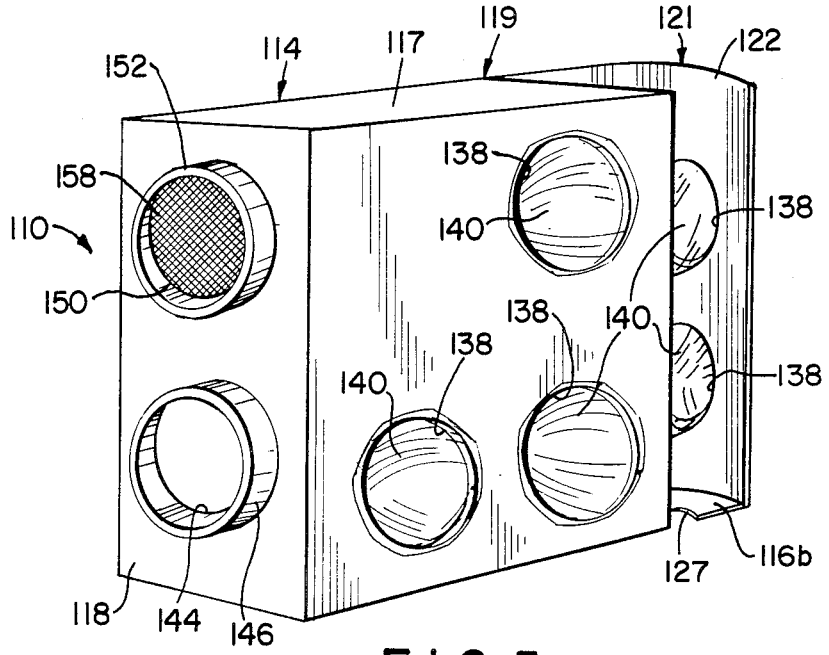
FIG. 5 is a perspective view of apparatus for removing contaminant material from a vertically arranged pipe according to the present invention.
Figure 6:
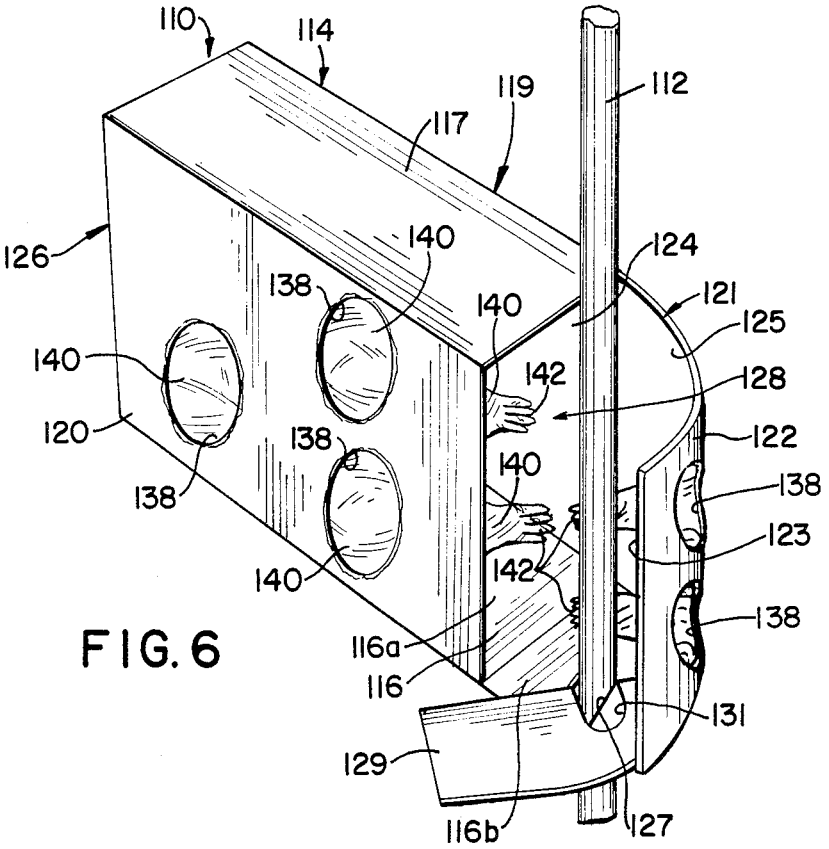
FIG. 6 is a different perspective view of the apparatus of FIG. 5, shown with a vertically arranged pipe received therein.

Referring now to FIGS. 5 and 6, apparatus 110 for removing asbestos from vertically arranged pipes 112 according to the present invention will now be described.

Apparatus 110 includes a box-like device 114 having a lower portion defined by a bottom wall 116, an upper portion defined by a top wall 117 and a broken away side wall 126 extending between the peripheral edges of bottom wall 116 and top wall 117. Specifically, box-like device 114 is formed with a substantially rectangular section 119 connected with a sector-shaped section 121. Bottom wall 116 thereby includes a rectangular shaped portion **116*a* and an attached sector-shaped portion 116*b* extending from a short edge of rectangular shaped portion 116*a*. Top wall 117 only includes a rectangular shaped portion which has an identical configuration to rectangular shaped portion 116*a* of bottom wall 116 and is positioned in spaced, parallel relation thereto. Side wall 126 includes side wall portions 120 and 124 arranged in parallel, spaced relation and which connect together the longer side edges of rectangular shaped portion 116*a* of bottom wall 116 with the respective longer side edges of top wall 117. Side wall 126 further includes an end wall 118 connected to side wall portions 120 and 124 and which also connects respective shorter side edges of rectangular shaped portion 116*a* of bottom wall 116 and top wall 117 together. In this regard, rectangular shaped portion 116*a*, top wall 117, side wall portions 120 and 124 and end wall 118 define an enclosure 128 therein, which is open at the opposite shorter side edges of box-like device 114**.

Side wall 126 further includes an arcuate portion 122 which is formed as a continuation of side wall 124 and is connected to the arcuate edge of sector-shaped portion **116*b* of bottom wall 116. It will be appreciated that side wall 126 includes an open portion 123 between the free end of arcuate portion 122 and the open free end of side wall portion 120. It will also be appreciated that top wall 117 does not extend into sector-shaped section 121, such that the upper portion of sector-shaped section 121 is completely open at 125. Still further, sector-shaped portion 116*b* of bottom wall 116 includes an open portion defined by an arcuate guide opening 127**.

With the arrangement thus far described, a vertically arranged pipe 112 can fit within arcuate guide opening 127 and open portions 123 and 125, as shown in FIG. 6. Thus, as the asbestos material is cut and scraped from pipe 112, it falls onto sector-shaped portion **116*b* of bottom wall 116. In this regard, in order to prevent such material from falling through arcuate guide opening 127, an auxiliary plate 129 having a guide opening 131 is positioned over sector-shaped portion 116*b* such that pipe 112 fits within guide opening 131. As a result, auxiliary plate 129 covers arcuate guide opening 127 to prevent the asbestos material from escaping therethrough. It will be appreciated that auxiliary plate 129 can be made of any suitable material, such as steel, plastic, foam rubber or the like. In this regard, pipe 112 can be positioned immediately adjacent to enclosure 128**.

Box-like device 114 further includes three glove apertures 138 in side wall portion 120 and two glove apertures 138 in acurate portion 122, and a glove 140 having finger portions 142 is associated with each glove aperture 138. Specifically, the open end of three gloves 140 are secured to the inner surface of side wall portion 120 in surrounding, and thereby sealing, relation to the respective glove aperture 138, with each glove 140 extending into enclosure 128 and the same applies with respect to arcuate portion 122. It will be appreciated that two glove apertures 138 in side wall portion 120 are provided in vertical spaced relation immediately adjacent the open end of rectangular shaped section 119 and the third glove aperture 138 is positioned immediately adjacent end wall 118. A similar set of three glove apertures 138 and gloves 140 can be provided in the opposite side wall portion 124. When pipe 112 is positioned within guide opening 127 and open portions 123 and 125, as shown in FIG. 6, a worker can insert his hands through the vertically spaced gloves 140 in side wall portion 120 and finger portions 142 thereof and through the gloves 140 in arcuate portion 122 and, with the aid of tools (not shown), can remove the asbestos material surrounding pipe 112.

In such case, the large chunks of asbestos material that are removed from pipe 112, will fall onto sector-shaped portion **116*b* of bottom wall 116. At such time, gloves 140 are used to push the chunks of asbestos material toward end wall 118**.

End wall 118 is formed with a lower opening 144 having a surrounding circular flange 146 for connection to the conduit 48 shown in FIG. 1. Accordingly, the chunks of asbestos material can be pushed through removal aperture 144 where the asbestos material travels through conduit 48 to waste container 46, whereby the bulk waste asbestos material can be contained in waste container 46 for disposal. Alternatively, a conventional waste disposal bag (not shown) can be secured to circular flange 146 in surrounding relation to removal aperture 144 for containing the bulk waste asbestos material.

As discussed above, when cutting, scraping and otherwise removing the asbestos material from pipe 112, the asbestos fibers tend to fly about, and thereby contaminate the room. Accordingly, a suction aperture 150 is formed in end wall 118 above removal aperture 144 and includes an outer circular flange 152 by which a suction conduit 54 can be connected thereto, the opposite end of suction conduit 54 being connected to a negative pressure system 56, as shown in FIG. 1. Further, as discussed above, suction aperture 150 is preferably covered with a pre-filter 158 which permits air to pass therethrough but which prevents the passage of asbestos fibers. Pre-filter 158 is removable secured to the inner surface of end wall 118. In this manner, the free floating asbestos fibers formed by the cutting, scraping and the like operation are pulled into enclosure 128 of box-like device 114 by negative pressure system 56 and are trapped by pre-filter 158, which can be changed periodically. Further, as discussed above, filters (not shown) are provided in negative pressure system 56, as is conventional.

Figure 2:
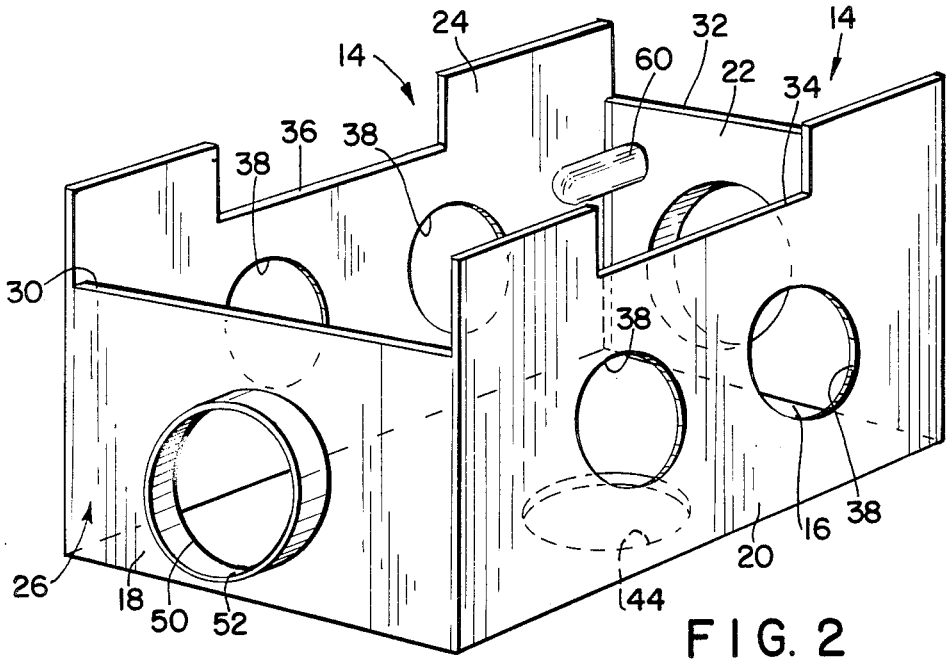
FIG. 2 is a perspective view of the box-like device of the apparatus of FIG. 1 without the gloves, pre-filters or mounting clips.
Figure 3:
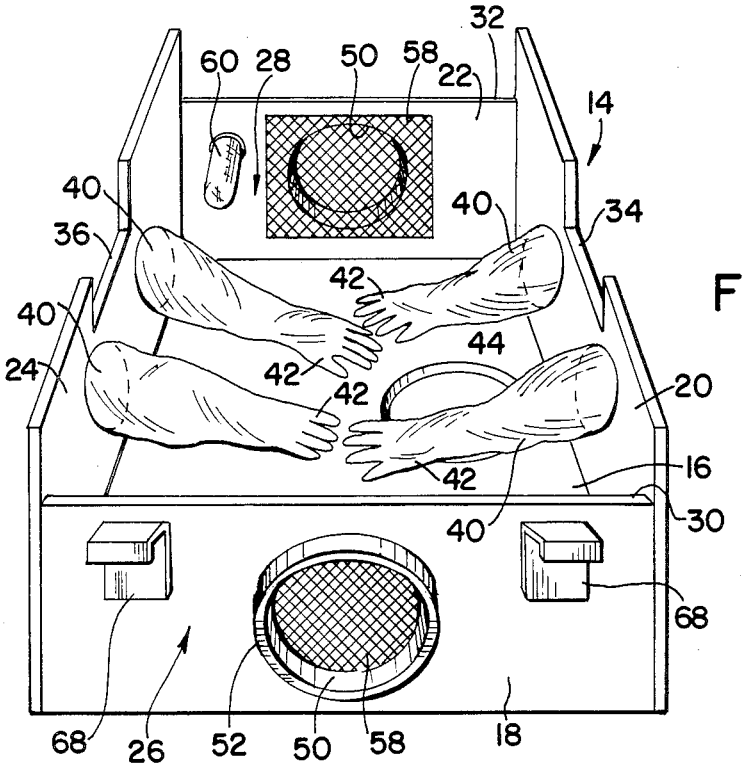
FIG. 3 is a perspective view of the box-like device of FIG. 2, with the mounting clips, gloves and pre-filters.
Figure 4:
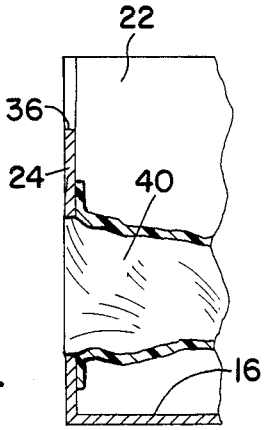
FIG. 4 is a cross-sectional view of a portion of the box-like device of FIG. 3, showing the attachment of the gloves thereto.

Box-like device 114 is mounted in the same manner as box-like device 14, that is, by the U-shaped bar 64 of negative pressure system 56 which connects with clips (not shown) on box-like device 114 of FIGS. 5 and 6, such clips being identical to clips 64 in the embodiment of FIG. 2. In addition, box-like device 114 can be moved vertically by means of a scaffold or the like. Also, a light similar to light 60 can be provided.

In operation, box-like device 114 is supported for movement in the vertical direction. At such time, a vertically arranged pipe 112 is fit within guide opening 127 and open portions 123 and 125 and plate 129 is provided in covering relation. Thereafter, negative pressure system 56 is operated. The worker then wets the insulation jacket containing the asbestos fibers which surround pipe 112 and cuts and removes such insulation jacket. The worker then scrapes off any additional material remaining on the pipes by means of tools, held by gloves 140. Such insulation material falls onto sector-shaped portion 116*b* of bottom wall 116 and is pushed by gloves 140 into enclosure 128 within rectangular shaped section 119 of box-like device 114. The material is then pushed further through removal aperture 144 where the material travels to waste container 46 through conduit 48. At the same time, negative pressure system 56 pulls all air containing the asbestos fibers through suction aperture 50, and pre-filter 58 filters out the asbestos fibers. Any asbestos fibers that happen to pass through pre-filter 158 are trapped in filters provided in negative pressure system 56, as is conventional.

During the operation, box-like device 114 is positioned at the bottom or lower end of pipe 112. The material is scraped from a small section of pipe 112. Thereafter, box-like device 114 is moved upwardly to the next section and the process continues, until all asbestos material has been removed from vertically arranged pipe 112. Alternatively, a plastic bag can be placed around the asbestos insulation, and then the insulation can be pulled downwardly into box-like device 114 for removal.

It will be appreciated that various modifications can be made to the invention within the scope of the claims herein. For example, although glove openings 38 and 138 have been shown only in side walls 26 and 126, such glove openings 38 and 138 can be provided in bottom walls 16 and 116, side walls 18 and 22, end wall 118 and top wall 117. In like manner, although suction openings 52 have been provided only in side walls 18 and 22 and suction opening 150 has been provided only in end wall 118, the suction openings can be provided in the bottom, top or other side walls of the box-like devices, as long as there is a negative pressure provided in the enclosures 28 and 128 of the box-like devices.

Having described specific preferred embodiments of the invention with reference to the accompanying drawings, it will be appreciated that the present invention is not limited to those precise embodiments, and that various changes and modifications can be effected therein by one of ordinary skill in the art without departing from the spirit or scope of the invention as defined by the appended claims.

What is claimed is:

1. Apparatus for removing contaminant material from at least one horizontally arranged pipe, said device comprising:

(a) a rigid box-like device including a lower portion having a periphery, and a substantially continuous side wall extending upwardly from the periphery of said lower portion so as to define an enclosure, said side wall having an upper edge;

(b) said box-like device having an open upper end defined by the upper edge of said side wall;

(c) at least one pair of opposing recesses formed at the upper edge of said side wall for receiving at least one pipe;

(d) at least one glove aperture formed in said side wall and/or said lower portion;

(e) a glove associated with each said glove aperture, each glove connected to said side wall and/or said lower portion in sealing relation to the respective glove aperture and extending into said enclosure;

(f) at least one suction aperture formed in said side wall and/or said lower portion for supplying a negative pressure to said enclosure; and (g) at least one removal aperture formed in said side wall and/or said lower portion for removing bulky portions of said contaminant material.

2. Apparatus according to claim 1; wherein said box-like device includes a first pair of opposing recesses formed at the upper edge of said side wall for receiving at least one pipe, and a second pair of opposing recesses formed at the upper edge of said side wall in orthogonal relation to said first pair of opposing recesses such that pipes having a linear arrangement, T-shaped arrangement and L-shaped arrangement can be received in said enclosure.

3. Apparatus according to claim 1; further including light means secured to an inner surface of said side wall for illuminating said enclosure.

4. Apparatus according to claim 1; further including filter means associated with each suction aperture for filtering airborne contaminant material when a negative pressure is supplied to said enclosure through said suction aperture.

5. Apparatus according to claim 1; wherein said box-like device further includes clip means secured to said side wall for supporting said box-like device on a support device.

6. Apparatus according to claim 1; wherein said lower portion is defined by a bottom wall and said side wall extends upwardly from the periphery of said bottom wall so as to define said enclosure.

7. Apparatus according to claim 6; wherein said bottom wall has a substantially rectangular configuration with four peripheral edges and said substantially continuous side wall is formed by four side wall sections, each extending upwardly from a peripheral edge of said bottom wall.

8. Apparatus according to claim 7; wherein said glove apertures are formed in two opposing side wall sections, said at least one suction aperture is formed in the remaining side wall sections and said at least one removal aperture is formed in said bottom wall.

9. Apparatus for removing contaminant material from at least one horizontally arranged pipe, said device comprising:

(a) a rigid box-like device including a lower portion having a periphery, and a substantially continuous side wall extending upwardly from the periphery of said lower portion so as to define an enclosure, said side wall having an upper edge;

(b) said box-like device having an open upper end defined by the upper edge of said side wall;

(c) at least one pair of opposing recesses formed at the upper edge of said side wall for receiving at least one pipe;

(d) at least one glove aperture formed in said side wall and/or said lower portion;

(e) a glove associated with each said glove aperture, each glove connected to said side wall and/or said lower portion in sealing relation to the respective glove aperture and extending into said enclosure;

(f) at least one suction aperture formed in said side wall and/or said lower portion for supplying a negative pressure to said enclosure; and (g) at least one removal aperture formed in said side wall and/or said lower portion for removing bulky portions of said contaminant material;

(h) negative pressure means for supplying a negative pressure to said enclosure;

(i) conduit means for connecting said negative pressure means to said at least one suction aperture;

(j) waste container means connected to said box-like device in communication with said at least one removal aperture for containing waste contaminant material pushed through said at least one removal aperture.

10. Apparatus according to claim 9; wherein said lower portion is defined by a bottom wall and said side wall extends upwardly from the periphery of said bottom wall so as to define said enclosure.

11. Apparatus according to claim 10; wherein said bottom wall has a substantially rectangular configuration with four peripheral edges and said substantially continuous side wall is formed by four side wall sections, each extending upwardly from a peripheral edge of said bottom wall.

12. Apparatus according to claim 11; wherein said glove apertures are formed in two opposing side wall sections, said at least one suction aperture is formed in the remaining side wall sections and said at least one removal aperture is formed in said bottom wall.

13. Apparatus for removing contaminant material from at least one vertically arranged pipe, said device comprising:

(a) a rigid box-like device including a lower portion having a periphery, an upper portion having a periphery and a side wall extending between the peripheries of said lower and upper portions so as to define an enclosure;

(b) said side wall, said lower portion and said upper portion being open along a portion thereof in communication with each other such that a vertically arranged pipe can fit within said open portions of said lower portion, said upper portion and said side wall so as to be positioned adjacent said enclosure;

(c) at least one glove aperture formed in said box-like device;

(d) a glove associated with each said glove aperture, each glove connected to said box-like device in sealing relation to the respective glove aperture and extending into said enclosure;

(e) at least one suction aperture formed in said box-like device; and (f) at least one removal aperture formed in said box-like device.

14. Apparatus according to claim 13; wherein said box-like device includes a main section forming said enclosure and an auxiliary section forming said open portions of said upper portion, said lower portion and said side wall such that said auxiliary section receives the vertically arranged pipe.

15. Apparatus according to claim 14; wherein said main section has a substantially rectanguiar configuration and said auxiliary section has a substantially sector shaped configuration.

16. Apparatus according to claim 14; wherein said box-like device further includes an auxiliary plate for covering said open portion of said lower portion after a pipe has been positioned therein.

17. Apparatus according to claim 14; wherein said lower portion includes a bottom plate extending along said main section and said auxiliary section; said side wall extends about said main section and only a portion of said auxiliary section; and said upper portion includes a top wall extending along said main section.

18. Apparatus according to claim 17; wherein said bottom plate extending into said auxiliary section includes an open guideway and said upper portion is open at said auxiliary section so that at least one pipe can fit within said guideway in said bottom plate, said open upper portion in said auxiliary section and said open portion of said side wall.

19. Apparatus according to claim 14; wherein said side wall extends around three sides of said main section and is open at a side thereof in said auxiliary section so as to define the enclosure in said main section; said side wall being open along a straight portion of said auxiliary section so as to define said open portion of said side wall.

20. Apparatus for removing contaminant material from at least one vertically arranged pipe, said device comprising:

(a) a rigid box-like device including a lower portion having a periphery, an upper portion having a periphery and a side wall extending between the peripheries of said lower and upper portions so as to define an enclosure;

(b) said side wall, said lower portion and said upper portion being open along a portion thereof in communication with each other such that a vertically arranged pipe can fit within said open portions of said lower portion, said upper portion and said side wall so as to be positioned adjacent said enclosure;

(c) at least one glove aperture formed in said box-like device;

(d) a glove associated with each said glove aperture, each glove connected to said box-like device in sealing relation to the respective glove aperture and extending into said enclosure;

(e) at least one suction aperture formed in said box-like device;

(f) at least one removal aperture formed in said box-like device;

(g) negative pressure means for supplying a negative pressure to said enclosure;

(h) conduit means for connecting said negative pressure means to said at least one suction aperture; and (i) waste container means connected to said box-like device in communication with said at least one removal aperture for containing waste contaminant material pushed through said at least one removal aperture.

21. Apparatus according to claim 20; wherein said box-like device includes a main section forming said enclosure and an auxiliary section forming said open portions of said upper portion, said lower portion and said side wall such that said auxiliary section receives the vertically arranged pipe.

22. Apparatus according to claim 21; wherein said main section has a substantially rectangular configuration and said auxiliary section has a substantially sector shaped configuration.

23. Apparatus according to claim 21; wherein said box-like device further includes an auxiliary plate for covering said open portion of said lower portion after a pipe has been positioned therein.

24. Apparatus according to claim 21; wherein said lower portion includes a bottom plate extending along said main section and said auxiliary section; said side wall extends about said main section and only a portion of said auxiliary section; and said upper portion includes a top wall extending along said main section.

25. Apparatus according to claim 24; wherein said bottom plate extending into said auxiliary section includes an open guideway and said upper portion is open at said auxiliary section so that at least one pipe can fit within said guideway in said bottom plate, said open upper portion in said auxiliary section and said open portion of said side wall.

26. Apparatus according to claim 21; wherein said side wall extends around three sides of said main section and is open at a side thereof in said auxiliary section so as to define the enclosure in said main section; said side wall being open along a straight portion of said auxiliary section so as to define said open portion of said side wall.

* * * * *